United States Patent [19]

Agoston

[11] Patent Number: 4,635,001

[45] Date of Patent: Jan. 6, 1987

[54] BEARING ARRANGEMENT IN A TUNABLE MAGNETRON

[75] Inventor: Andras Agoston, Täby, Sweden

[73] Assignee: U.S. Philips Corporation, New York, N.Y.

[21] Appl. No.: 755,747

[22] Filed: Jul. 16, 1985

[30] Foreign Application Priority Data

Jul. 17, 1984 [SE] Sweden ..... 8403747

[51] Int. Cl.[4] ..... H01J 25/50

[52] U.S. Cl. ..... 331/90; 315/39.51; 315/39.61

[58] Field of Search ..... 331/86, 90; 315/39.51, 315/39.55, 39.53, 39.59, 39.61; 333/224, 229

[56] References Cited

U.S. PATENT DOCUMENTS 3,222,564 12/1965 DePue ..... 333/229 X
3,247,421 4/1966 Backmark ..... 315/39.61
4,281,273 7/1981 Baker ..... 315/39.51 X

FOREIGN PATENT DOCUMENTS 0150540 11/1980 Japan .
0622009 4/1949 United Kingdom .
1461008 1/1977 United Kingdom .

*Primary Examiner*—Eugene R. LaRoche
*Assistant Examiner*—Robert J. Pascal
*Attorney, Agent, or Firm*—Robert J. Kraus

[57] ABSTRACT

A bearing arrangement in a tunable magnetron, in which a sleeve-shaped body (12) is journalled on a central column (10) by means of two bearings (14, 15). The distance between the inner rings (18, 19) and outer rings (22, 23) of the bearings is determined by distance means (20, 21) which generally can be sleeve-shaped. According to the invention, at least one distance means, suitably both distance means, is temperature compensated by being composed of an odd number of partial elements (30–32; 37–39). The elements all extend in the longitudinal direction of the distance means, and each distance means includes two end elements (30, 32; 37, 39) which bear against the respective bearing part (18, 19; 22, 23) and an intermediate element (31; 38). The elements in each distance means are in such force-transmitting connection with each other that, with temperature variations, two adjacent elements impart to the distance means length variations in opposite direction. The total length of all elements acting in one direction is so selected in relation to the total length of all elements acting in the opposite direction, and in relation to the linear expansion coefficients for the different elements, that a predetermined variation of the total length of the distance means with the temperature is obtained.

7 Claims, 2 Drawing Figures

BEARING ARRANGEMENT IN A TUNABLE MAGNETRON

BACKGROUND OF THE INVENTION

The invention relates to an arrangement in a tunable magnetron comprising a sleeve-shaped body which by means of two bearings is rotatably journalled on a stationary column or pillar and which at one end supports a tuning body projecting into the resonance cavities of the magnetron. An inner bearing part of a bearing has a fixed position relative to the column and an outer bearing part of a bearing has a fixed position relative to the sleeve-shaped body, while the distance between the bearings is determined by distance means.

A magnetron of this general construction is described in Swedish Pat. No. 191,373 (corresponding to U.S. Pat. No. 3,343,031), for example. The tuning body here has portions of different electric conductivity, formed, for example, by means of circumferentially distributed teeth or apertures in the body, and projects through a gap made in the rear part of the anode plates defining the resonance cavities. In order to achieve a high efficiency the gap is made very small, as large gaps between the tuning body and the anode plates will reduce the efficiency.

Small gaps will result in high requirements on the bearing, in particular as regards freedom from play. Due to the small dimensions of the gaps there is already a very small play, and consequent inclination of the sleeve-shaped body will result in an appreciable influence on the electric HF signal generated by the magnetron, in particular the frequency of the signal. Play in the bearings can furthermore result in vibrations so that the operating life of bearings and thereby of the whole magnetron will be reduced. Very high requirements are therefore imposed upon the bearing for both electrical and mechanical reasons.

To avoid play in the bearings it is important that both bearings are loaded, or in other words that they are biased. The biasing force can be achieved in different ways depending upon how the contact lines through the contact points in the bearings are oriented. In principle the contact lines can be parallel or intersecting. The latter lines can intersect each other either between or beyond the bearings. These different types of biasing forces are often called: "tandem", "face--to-face" and "back-to-back". The parallelism and symmetry can be more or less exact, dependent on practical circumstances.

Besides freedom from play it is of great importance that the bearings are not too heavily loaded. The biasing involves, as a rule, a certain increase of the friction in the bearing and this friction must be kept low and accurately limited.

These requirements should be fulfilled even in several operating conditions, i.e. involving operation of the bearings in a vacuum and under varying temperature conditions. The temperature will vary from the surrounding temperature at the start to varying high temperatures during operation, depending upon frequent variations of the electric power applied to the magnetron and variations of the microwave power delivered by the magnetron. Due to the effective thermal insulation between the different parts in the radial direction of the bearing arrangement there is furthermore, in the steady state, a high temperature gradient in the radial direction. In contrast to this, the temperature gradient in the axial direction is small because both the central column supporting the whole bearing arrangement and the rotatably-journalled sleeve are usually made of materials having good heat conductivity. The bearings must operate without play and with a low friction within the whole temperature range.

In such magnetrons it is usual that the sleeve-shaped body is influenced by a continuous axial magnetic force. By means of this force a biasing of the tandem type can be achieved. It is then important that both bearings are loaded and in such a way that they have the same loading and each take up half the force.

Many solutions of the bearing problem in tunable magnetrons of the above-described kind have been proposed. A bearing arrangement is described in European Pat. No. 0009903 (corresponding to U.S. Pat. No. 4,281,273), for example in which both the inner rings and the outer rings of the bearings are displaceably arranged on a fixed column in the rotating sleeve body. The outer rings of the bearings together with a distance sleeve arranged between them are pressed against a fixed stop on the rotating sleeve. The inner rings are, on the one hand, influenced by a spring pressing the whole assembly of inner rings and intermediate distance elements against a stop on the column and on the other hand, by a spring included in the distance element and pressing the two inner rings away from each other. The stop on the column is furthermore adjustable in the axial direction. This adjustment of the stop on the column is then carried out in such manner that the load is distributed in the desired manner between the bearings. During the adjustment, as well as during thermally-induced variations during operation, the inner rings of the two bearings will be displaced on the column. The adjustment for achieving the desired distribution of the load between the bearings is very critical. If the spring characteristic of the springs should vary with time adjustment will be erroneous. Another drawback of this arrangement is that the inner and outer bearing rings must have loose tolerances against the column and the sleeve body, respectively, which in itself involves play and can give rise to vibrations.

SUMMARY OF THE INVENTION

An object of the invention is to make a bearing arrangement in a tunable magnetron of the kind described in which freedom from play is obtained in both bearings within the whole temperature range and without the necessity of complicated and critical adjustment operations and without deterioration of the properties of the bearings by means of a loose fit with play at several places.

According to the invention this is achieved by means of an arrangement of the kind described, which is characterized in that, for the purpose of temperature compensation, at least one distance means comprises at least three elements which partly overlap each other in the direction of length of the column. These elements are made of at least two materials having different linear expansion coefficients. They comprise two end elements abutting at one end the respective bearing part, and at least one intermediate element. Adjacent elements adjoin each other at their ends so that, with temperature variations, two adjacent elements will impart to the distance means length variations in opposite directions. The total length of all elements producing a length variation in one direction is so selected relative to the total length of all elements producing a length variation in the opposite direction, and relative to the linear expansion coefficients of the materials of the different elements, that a desired variation of the total length of the distance means with temperature is obtained.

The number of elements will always be an odd number. If the elements are numbered consecutively from one bearing to the other, those elements which cooperate in one direction will be the elements having odd numbers, while the elements which cooperate mutually and counteract the first elements will all be elements having even numbers.

By means of the invention, the longitudinal expansion of a distance means due to temperature variations can in principle be adapted accurately to the expansion of the other parts of the bearing arrangement so that a ratio between the load of the two bearings, initially set during manufacture due to fixed stops, will be maintained within the whole temperature range. The invention also makes practical the manufacture of magnetrons having all kinds of biasing of the bearing without deviating from the requirement for low and accurately-determined friction. Biasing of the "back-to-back" type gives, for example, a more stable and thereby a more accurate construction than the "tandem" or "face-to-face" types.

Preferably, both distance means are provided with the same temperature compensation as the one described, whereby no relative motion between the inner and outer parts of the two bearings due to temperature variations will occur within the whole temperature range. This will contribute to a more accurate biasing with freedom of play and low friction.

A further improvement can be achieved if the column, and suitably also the sleeve-shaped body, are provided with the same temperature compensation as the distance means with respect to that part of the column or the sleeve-shaped body, respectively, which is situated between the bearings. Then, no relative motion will take place as a result of temperature variations and both bearings could in principle be mounted without a loose fit on the column and in the sleeve-shaped body.

The elements are suitably shaped as sleeves arranged within each other.

In a preferred embodiment the lengths are so selected relative to the linear expansion coefficients that the total longitudinal variation with variations in the temperature will be substantially equal to zero within the operational temperature range of the magnetron.

Suitably all elements having an odd number can be made of one material and all elememts having an even number can be made of another material, the ratio between the total length of the first elements and the total length of the last elements being inversely proportional to the ratio between the expansion coefficients of the materials of the elements. In a combination of materials which has proved to give good results the material of the elements having odd numbers including the two end elements is molybdenum and the material of the elements having even numbers is stainless steel.

BRIEF DESCRIPTION OF THE DRAWING

The invention is illustrated by way of example with reference to the accompanying drawing, in which.

DESCRIPTION OF THE PREFERRED EMBODIMENT

Figure 1:
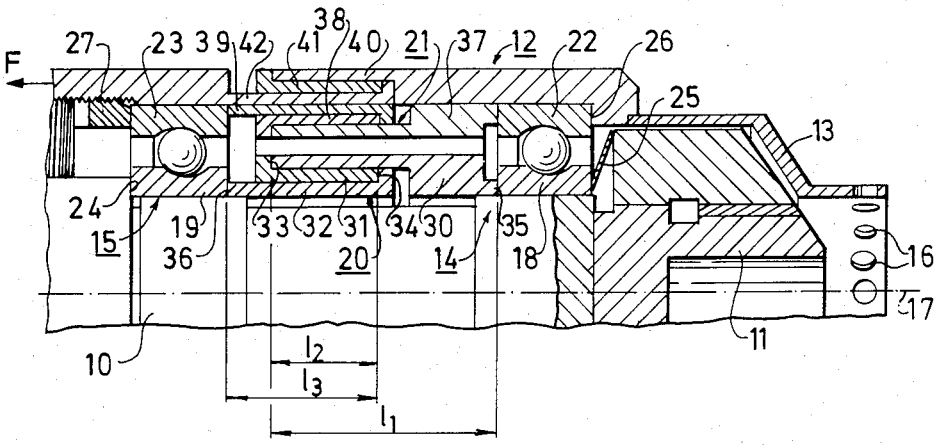
FIG. 1 shows a longitudinal sectional view through a part of a tunable magnetron which has a bearing arrangement with temperature compensation according to the invention introduced in both distance sleeves and in the sleeve-shaped rotor.

In FIG. 1 reference numeral 10 designates a fixed centrally located column, which at one end is terminated by a magnetic pole shoe 11, while 12 designates a sleeve-shaped rotor which at one end supports a sleeve-shaped tuning body 13 and which is rotatably journalled on the column 10 by means of two ball bearings 14, 15. The tuning body projects at its free end into the resonance cavities via grooves cut in the rear edge of the anode plates (not shown) and is provided in this region with apertures 16 distributed around its circumference for producing a tuning variation upon rotation of the body 13 about the axis 17. Between the inner rings 18, 19 of the ball bearings there is a distance sleeve 20 and a similar distance sleeve 21 is arranged between the outer rings 22, 23 of the bearings. The assembly consisting of the inner rings 18, 19 and the distance sleeve 20 is pressed against a stop 24 on the column by means of a spring washer 25 and the assembly consisting of the outer rings 22, 23 and the distance sleeve 21 is pressed against a stop 26 on the rotor body 12 by means of a screw-threaded ring 27. The sleeve-shaped rotor 12 is furthermore continuously subjected to an axial force F in the direction of the arrow, for example, a force produced magnetically.

The inner bearing rings can suitably be arranged on the column with a press fit. As a result of increased temperature in operation this press fit will change to a sliding fit without introducing play.

According to the invention at least one distance sleeve is provided with temperature compensation. In FIG. 1 temperature compensation is introduced in both distance sleeves and also in the sleeve-shaped rotor. Only the inner distance sleeve will be described in detail.

The inner distance sleeve, as shown in FIG. 1, is composed of three partial sleeves 30, 31, 32 of which the outer and the inner sleeves 30, 32 are made of one material while the intermediate partial sleeve 31 is made of another material. The outer partial sleeve 30 bears at one end against a shoulder 33 on the intermediate partial sleeve 31 and the intermediate sleeve 31 bears at one end against a shoulder 34 on the inner partial sleeve 32. The partial sleeves are free to move relative to each other. The outer partial sleeve 30 bears at its other end 35 against the inner ring 18 of the bearing 14, while the inner partial sleeve 32 bears at its other end 36 against the inner ring 19 of the other bearing 15.

The total length of the inner distance sleeve 20, which is decisive for the distance between the inner rings of the ball bearings, is determined by the length of the individual partial sleeves, measured between the abutment places. For the total length L the following relationship is valid:

$$L=l_1-l_2+l_3$$

where $l_1$, $l_2$; $l_3$ are the lengths of the partial sleeves according to FIG. 1.

At temperature variations the intermediate partial sleeve 31, which is made of one material, will counteract the other two partial sleeves which are made of another material. The resulting length variation ΔL for a temperature variation Δt will be:

$$\Delta L = l_1 \Delta_1 \Delta t - l_2 \Delta_2 \Delta t + l_3 \alpha_1 \Delta t$$

where $\alpha_1$ is the linear expansion coefficient of the material of the partial sleeves 31, 32 and $\alpha_2$ is the linear expansion coefficient of the material of the partial sleeve 31. If the resulting length variation is to be equal to zero the following is valid:

$$l_1 \alpha_1 \Delta t - l_2 \alpha_2 \Delta t + l_3 \alpha_1 \Delta t = 0$$

or $$(l_1 + l_3)/l_2 = \alpha_2/\alpha_1.$$

In order to ensure that the distance sleeve does not change its length due to temperature variations, in this example the ratio between the total length of the outer and inner partial sleeves of the first material and the length of the intermediate sleeve of the section material should be inversely proportional to the ratio between the linear expansion coefficients.

In the present example it is assumed that the partial sleeves 30, 32 are made of molybdenum having the expansion coefficient $\alpha_{Mo} \approx 5.10^{-6}$ mm/°C. while the sleeve 31 is made of austenitic stainless steel having the expansion coefficient $\alpha_{St} \approx 17.10^{-6}$ mm/°C. The total length of the sleeves 30, 32 will thus be approximately 3.4 times the length of the sleeve 32.

In a manner similar to the inner distance sleeve the outer distance sleeve is composed of partial sleeves 37, 38 and 39. The sleeve-shaped rotor also is temperature compensated in the example shown and is composed of the three partial sleeves 40, 41 and 42.

Figure 2:
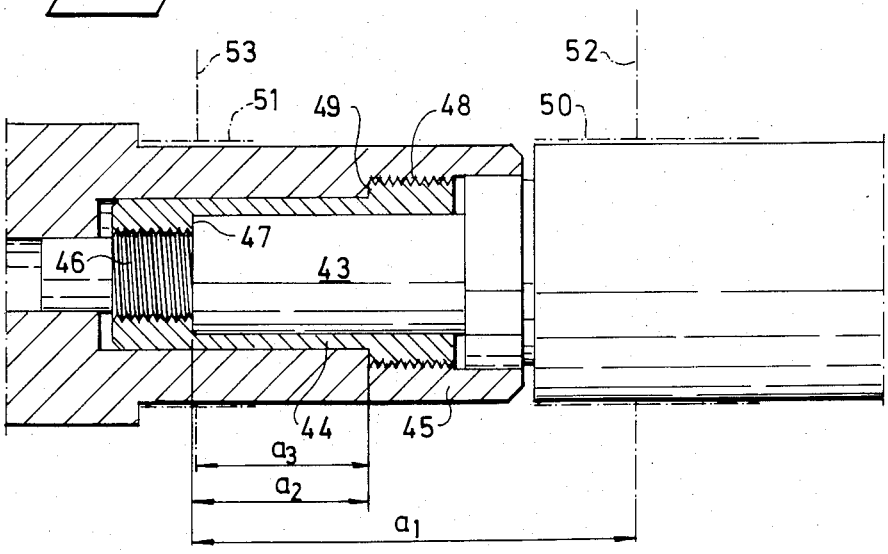
FIG. 2 shows a longitudinal sectional view through the central column, which is provided with temperature compensation according to the invention.

FIG. 2 shows how the central column can be constructed to have a corresponding temperature compensation. The illustrated section of the column consists of three parts, namely an inner cylindrical part 43, a sleeve-shaped intermediate part 44 and a sleeve-shaped outer part 45. By means of a screw-thread 46 the intermediate part 44 is screwed onto the inner part 43 until a shoulder on the intermediate part abuts a shoulder on the inner part at 47, and by means of a screw-thread 48 the outer part 45 is screwed onto the intermediate part until a shoulder on the outer part abuts a shoulder on the intermediate part at 49. The support surfaces for the inner bearing rings are indicated by the dot-dash lines 50 and 51 and the center lines of the ball races are designated 52, 53.

In this case a first distance $a_1$ is defined as the distance between the center line 52 and the stop surface 47, while a second distance $a_2$ is defined as the distance between the stop surfaces 47 and 49 and a third distance $a_3$ is defined as the distance between the stop surface 49 and the center line 53. In order to ensure a constant distance between the center lines 52 and 53 independently of the temperature, in this case the following relationship should be fulfilled:

$$(a_1 + a_3)/a_2 = \alpha_2/\alpha_1.$$

In a preferred embodiment, temperature compensation of the kind described is introduced in the central column as well as in the two distance sleeves and in the rotor.

As previously stated, the sleeve-shaped rotor is continuously subjected to an axial force F, which is taken up by the bearings. In the example shown the bearings are so biased that the force vectors in the two bearings have the same direction, a so-called tandem arrangement, and furthermore that the bearings each take up half the force. Due to the described temperature compensation of the central column, the distance sleeves and the rotor, this initially-set condition will be maintained in the whole temperature range, whereby both bearings will operate without play within the whole temperature range.

A number of modifications of the described arrangement are possible within the scope of the invention. Thus, the partial elements of the distance means need not be shaped as sleeves but can, for example, be shaped as rods, a number of such distance means composed of rods distributed around the circumference. The number of individual parts in each distance means need not be three, but can be an arbitrary odd number. It is not necessary that the resulting length variation with temperature is zero, but the temperature compensation can be such that a controlled length variation with temperature is achieved. Such a controlled-length variation would be adapted to a known length variation of another part of the arrangement, which may in turn be without temperature compensation or may possibly be provided with corresponding temperature compensation. This will permit arrangements with other types of biasing, for example, "back-to-back" or "face-to-face", and the use of different types of ball bearings.

What is claimed is:

1. An arrangement in a tunable magnetron comprising a sleeve-shaped body which by means of first and second bearings is rotatably journalled on a longitudinally extending supporting member and which at one end supports a tuning body projecting into resonance cavities of the magnetron, an inner bearing part of one of the bearings having a fixed position relative to the supporting member and an outer bearing part of one of the bearings having a fixed position relative to the sleeve-shaped body, the distance between the bearings being determined by at least one temperature-compensated distance means, characterized in that for the purpose of temperature compensation said at least one distance means comprises at least three elements which partly overlap each other in the longitudinal direction of the supporting member, at least two of the elements consisting essentially of materials having different linear expansion coefficients, said overlapping elements including two end elements and at least one intermediate element, the two end elements each having one end abutting a respective one of the bearings, adjacent elements adjoining each other at their ends so that with temperature variations two of said ajacent elements will impart to the distance means formed thereby length variations in opposite directions, the total length of all elements producing length variations in one direction being selected relative to the total length of all elements producing length variations in the opposite direction and relative to the linear expansion coefficients of the materials of the different elements, that a predetermined variation of the total length of the distance means with the temperature is obtained.

2. An arrangement as claimed in claim 1 including first and second ones of said temperature-compensated distance means, said first distance means spacing inner parts of the first and second bearings and said second distance means spacing outer parts of the first and second bearings.

3. An arrangement as claimed in claim 1 or 2, characterized in that at least one of the supporting member and the sleeve-shaped body is provided with temperature compensation means for cooperating with the at least one temperature-compensated distance means.

4. An arrangement as claimed in claim 1 or 2, characterized in that the overlapping elements are shaped as concentric sleeves.

5. An arrangement as claimed in claim 1 or 2, characterized in that said lengths are so selected relative to the linear expansion coefficients that the total length variation with variation in temperature is substantially equal to zero within the operational temperature range of the magnetron.

6. An arrangement as claimed in claim 5, characterized in that alternate ones of the overlapping elements consist essentially of a first material and all other overlapping elements consist essentially of a second material, the ratio between the total length of the elements of the first material and the total length of the elements of the second material being inversely proportional to the ratio between the linear expansion coefficients of the first and second materials.

7. An arrangement as claimed in claim 1 or 2, characterized in that the two end elements consist essentially of molybdenum and that said at least one intermediate element consists essentially of stainless steel.

* * * * *